US009627819B2

(12) United States Patent
Post et al.

(10) Patent No.: US 9,627,819 B2
(45) Date of Patent: Apr. 18, 2017

(54) INSULATION INSERT WITH AN INTEGRATED SHIELDING ELEMENT

(71) Applicant: Harting Electronics GmbH, Espelkamp (DE)

(72) Inventors: Dirk Peter Post, Luebbecke (DE); Melanie Genau, Luebbecke (DE); Klaus Kraemer, Osnabrueck (DE); Volker Beuth, Stemwede (DE); Stephan Schreier, Rahden (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/648,041

(22) PCT Filed: Sep. 26, 2013

(86) PCT No.: PCT/DE2013/100344
§ 371 (c)(1),
(2) Date: May 28, 2015

(87) PCT Pub. No.: WO2014/082623
PCT Pub. Date: Jun. 5, 2014

(65) Prior Publication Data

US 2015/0295365 A1 Oct. 15, 2015

(30) Foreign Application Priority Data

Nov. 30, 2012 (DE) ..... 10 2012 111 646

(51) Int. Cl.
*H01R 13/6599* (2011.01)
*H01R 13/40* (2006.01)
(Continued)

(52) U.S. Cl.
CPC ..... *H01R 13/6599* (2013.01); *H01R 13/40* (2013.01); *H01R 13/6592* (2013.01); *H01R 13/6585* (2013.01)

(58) Field of Classification Search
USPC ..... 439/607.03, 660, 607.05, 607.01, 607.55
See application file for complete search history.

(56) References Cited

U.S. PATENT DOCUMENTS 3,958,851 A * 5/1976 Evans ..... H01R 9/0518 439/295
5,232,380 A * 8/1993 Inoue ..... H01R 13/6593 439/585

(Continued)

FOREIGN PATENT DOCUMENTS

CN 101119001 2/2008
CN 101562284 10/2009

(Continued)

*Primary Examiner* — Alexander Gilman
(74) *Attorney, Agent, or Firm* — Jacobson Holman, PLLC.

(57) ABSTRACT

The invention relates to an insulation insert that can be inserted into a plug-in connector housing (11) of a plug-in connector (10), wherein in the insulation insert (1), at least one contacting element for electrically contacting a conductor core of a cable (12) to be connected may be provided, wherein the insulation insert (1) is provided in one area with a conductive coating, wherein the coated area forms a shielding element (3) that can be electrically contacted with a shielding braid of the cable (12) to be connected and at the same time with the plug-in connector housing (11), and wherein the insulation insert (1) and the shielding element (3) are integrally formed in.

16 Claims, 2 Drawing Sheets

Figure 1:
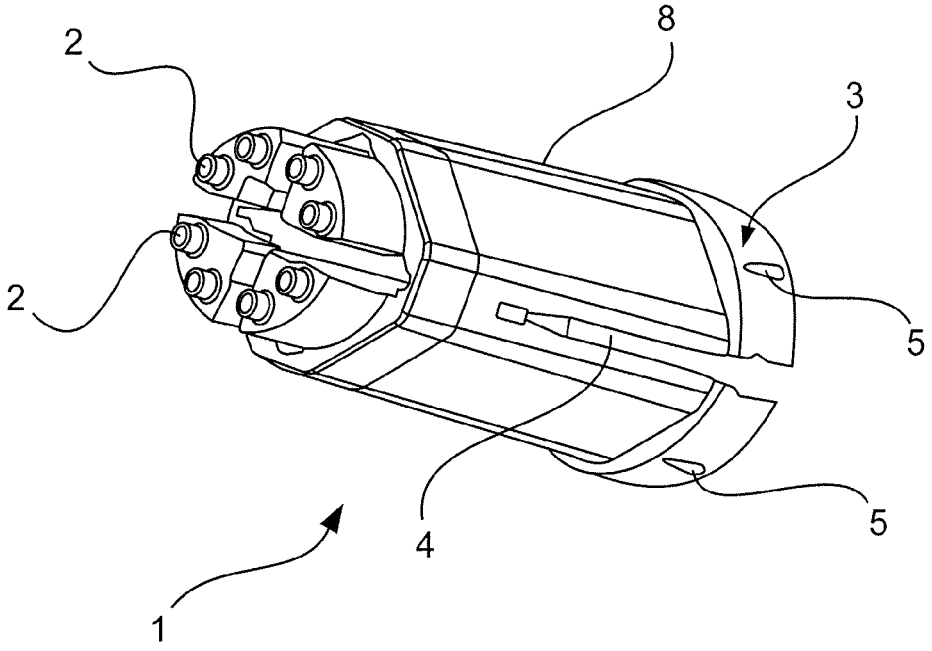

(51) Int. Cl.
*H01R 13/6592* (2011.01)
*H01R 13/6585* (2011.01)

(56) References Cited

U.S. PATENT DOCUMENTS

| | | | | |
|---|---|---|---|---|
| 6,575,784 | B1 | 6/2003 | Yamada | |
| 7,147,509 | B1 * | 12/2006 | Burris | H01R 9/0521 439/578 |
| 2002/0119699 | A1 * | 8/2002 | Leve | H01R 13/5829 439/578 |
| 2008/0032556 | A1 * | 2/2008 | Schreier | H01R 9/032 439/607.41 |
| 2009/0264017 | A1 * | 10/2009 | Malstrom | H01R 24/52 439/607.01 |
| 2010/0136856 | A1 * | 6/2010 | Gleason | A61B 18/14 439/886 |
| 2012/0135629 | A1 * | 5/2012 | Montena | H01R 12/70 439/359 |
| 2012/0309227 | A1 * | 12/2012 | Montena | H01R 9/032 439/578 |
| 2013/0137310 | A1 * | 5/2013 | Genau | H01R 12/724 439/660 |
| 2014/0120769 | A1 * | 5/2014 | Dang | H01R 13/6586 439/607.05 |
| 2014/0235101 | A1 * | 8/2014 | Derbogen | H01R 9/032 439/607.01 |
| 2014/0235105 | A1 * | 8/2014 | Friedhof | H01R 13/6461 439/607.55 |
| 2014/0242840 | A1 * | 8/2014 | Dang | H01R 13/6461 439/607.01 |
| 2015/0104964 | A1 * | 4/2015 | McIntosh | H01R 13/521 439/271 |

FOREIGN PATENT DOCUMENTS

| | | |
|---|---|---|
| CN | 102593637 | 7/2012 |
| CN | 102687209 | 9/2012 |
| DE | 2557598 | 7/1976 |
| DE | 69417224 | 9/1999 |
| DE | 19907245 | 8/2000 |
| DE | 102004032006 | 4/2006 |
| EP | 0693795 | 1/1996 |
| EP | 0945929 | 5/2003 |
| EP | 1424750 | 6/2004 |
| EP | 1898682 | 3/2008 |
| EP | 1649554 | 5/2012 |
| FR | 2921522 | 3/2009 |
| JP | 2012-059516 | 3/2012 |
| JP | 2012190632 | 10/2012 |
| JP | 2012199223 | 10/2012 |

* cited by examiner

INSULATION INSERT WITH AN INTEGRATED SHIELDING ELEMENT

The invention relates to an insulation insert of a plug-in connector according to the preamble of claim 1 and to a plug-in connector that uses such an insulation insert according to claim 9.

Plug-in connectors with such insulation inserts shield the contact elements against electromagnetic radiation and in this way ensure good signal integrity. They are particularly suitable for high data transmission rates.

PRIOR ART

EP 945929 B1 shows a plug-in connector, the contact elements of which are inserted into shielded chambers of the insulation insert. The shielding braid of the connected cable is fastened to the insulation insert by means of a crimp ring.

It is also known from the prior art to crimp the shielding braid of the connected cable between a seal and a shielding element that is fastened to the insulation insert.

Due to the large number of parts, the packaging of such plug-in connectors is quite time-consuming. Moreover, fastening the shielding braid via a crimp ring constitutes a potential source of errors because the crimp ring can easily slip whilst being inserted into the plug-in connector housing.

OBJECT OF THE INVENTION

The object of the invention is to propose a plug-in connector that can be easily packaged and at the same time offers reliable shielding.

The object is achieved by means of the characterising features of claim 1

Advantageous embodiments of the invention are set out in the dependent claims.

As a rule, at least one contact element is embedded in the insulation insert proposed here. The contact element is connected to a conductor core of a cable to be connected. As a rule, a plurality of contact elements will be embedded in the insulation insert, which are each electrically connected to a conductor core of a multicore cable.

The insulation insert can be pushed into a housing of a plug-in connector. The plug-in connector housing may be formed in several parts.

The insulation insert further comprises a shielding element that can be contacted with the shielding braid of the cable to be connected. The shielding element at the same time also contacts the electrically conducting housing of the plug-in connector and therefore transfers the cable shielding to the latter. For contacting the housing, the shielding element comprises contacting means, which will be described in more detail below.

According to the invention it is provided to form the insulation insert and the shielding element as a single component, i.e. integrally. As a result, at least one component and one packaging step in the packaging of the plug-in connector are eliminated. However, the structural unity of the insulation insert and the shielding element offers a further advantage that goes beyond the simplification of packaging. The transfer of the cable shielding to the plug-in connector housing is here far more reliable than in the case of prior art plug-in connectors. Here, the insulation insert made of plastic and the shielding element formed from sheet metal are merely plugged together. It is possible here for the shielding element and the insulation insert to slip relative to each other during packaging, as opposed to the insulation insert according to the invention.

Moreover, plug-in connectors according to the invention can be packaged much more quickly.

Advantageously, the integral design of the insulation insert and the shielding element is achieved by means of the fact that a plastic body is produced in a two-component injection moulding procedure and is subsequently, at least partially by means of an MID process, provided with a conductive coating. The coated area of the insulation insert substantially forms the shielding element. The uncoated part of the plastic body substantially constitutes the insulation insert.

A two-component injection moulding method, also referred to as 2C injection moulding process, with subsequent MID coating is sufficiently known from EP 1898682 B1.

The insulation insert is substantially made from a plastic body that is partially provided with a conductive coating. The coated area substantially forms a shielding element. This means that the shielding element is made from a plastic material that is metallically coated. The shielding element may be electrically contacted with a shielding braid of a cable to be connected and at the same time with the plug-in connector housing.

At least one, preferably at least two clamping means are moulded onto the plastic body of the insulation insert. Advantageously, the clamping means are provided on the coated part of the insulation insert. By means of the clamping means, the insulation insert may be clamped in the plug-in connector housing. In a particularly preferred embodiment, the insulation insert, including the clamping means and the shielding element, are integrally formed. The shielding element and the clamping means are formed by the coated area of the insulation insert. This design of the insulation insert makes the packaging of the plug-in connector particularly simple.

Since the clamping means are provided in the coated area of the plastic body and the shielding element, including the plastic underneath it, is formed by the coating, one can also refer to this as a unit of shielding element and clamping means.

Or in other words, the shielding element preferably also includes damping means that are suitable for clamping in a captive manner and/or electrically contacting the shielding element with the plug-in connector housing. As a result, the insulation insert is clamped in the plug-in connector housing, which simplifies the further assembly of the plug-in connector, if the clamping means are also used for contacting the plug-in connector housing, they will at the same time take over the function of a contacting means as described above. The contacting with the plug-in connector housing is, inter alia, carried out for grounding purposes.

Advantageously, the above-mentioned clamping means are webs which are moulded onto the plastic body during the injection moulding process. The webs advantageously have a shape that tapers (in an arrow-like manner) in the plug-in direction. As a result, the insulation insert together with the shielding element can be clamped in the plug-in connector housing with little physical effort.

Often, at least two or more contact elements for electrically contacting in each case one cable core of a multicore cable are provided in the insulation insert. In this case it appears to be expedient to shield the at least two contact elements electromagnetically from each other by a second shielding element. It may also be expedient, for example in the case of four-pole plug-in connectors, to shield in each case two contact elements from each other in a pairwise manner. The signal integrity of multi-pole plug-in connectors is improved by means of a second shielding element. Or in other words: signal interferences between the individual data lines are reduced.

In an advantageous embodiment of the invention, the second shielding element is made from a plastic that is metallically coated using an MID process.

It is particularly advantageous if the insulation insert, the shielding element and the second shielding element are integrally formed. The packaging of the plug-in connector is again substantially simplified and accelerated by a structural unit that comprises three functional components.

EMBODIMENT EXAMPLE

Figure 2:
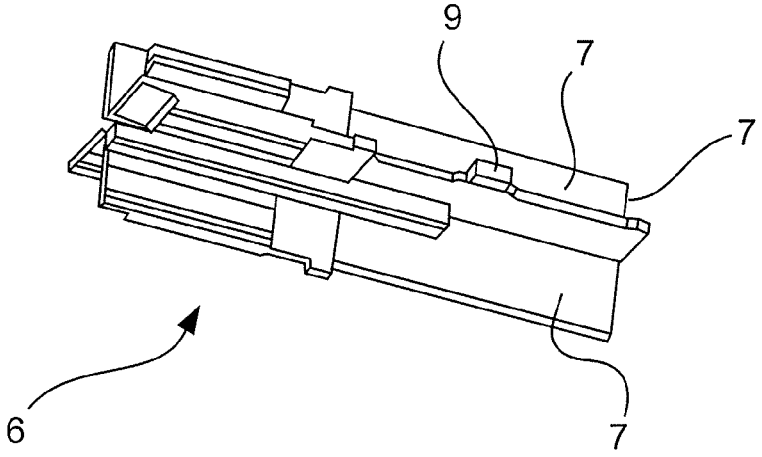
Figure 3:
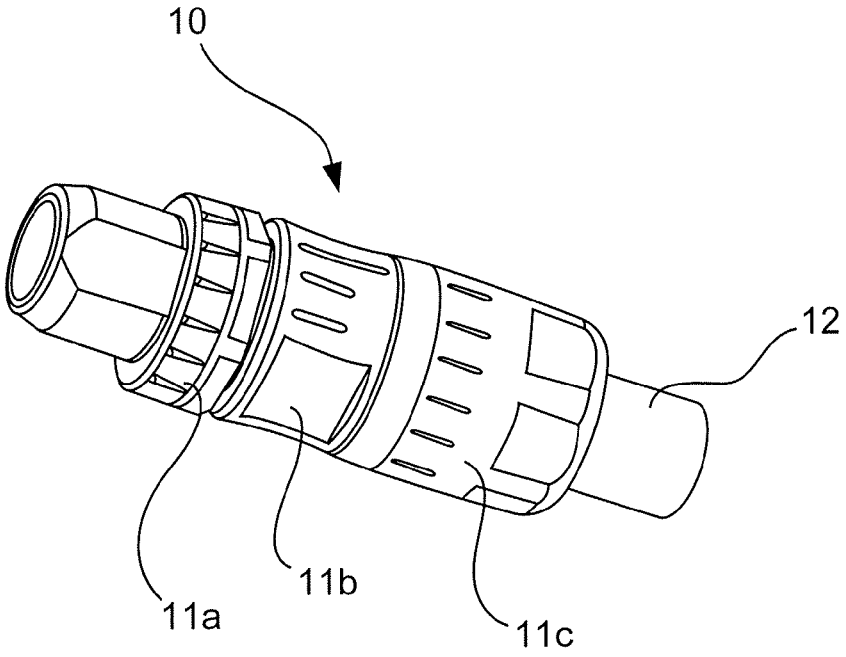
Figure 4:
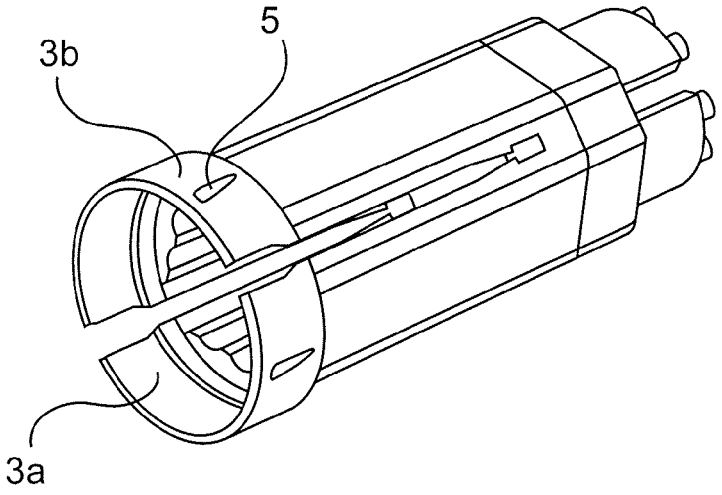

An embodiment example of the invention is shown in the drawings and will be explained in more detail below, wherein:

FIG. 1 shows a perspective view of an insulation insert of a plug-in connector, FIG. 2 shows a perspective view of a second shielding element, FIG. 3 shows a perspective view of a complete plug-in connector with a connected multicore cable, and FIG. 4 shows a further perspective view of the insulation insert of the plug-in connector.

FIG. 1 shows a possible embodiment of an insulation insert 1 according to the invention. The insulation insert 1 substantially has the form of a hollow cylinder that is provided on the plug-in side with bores 2 in the end face, through each of which a contact element (not shown) protrudes. On the connection side, the insulation insert 1 has a shielding element 3 that is interrupted by axially extending slots 4. The axial slots 4 extend beyond the shielding area further in the plug-in direction. The length of the axial slots 4 corresponds to approximately two thirds of the overall length of the insulation insert. It has been shown that this slot length is particularly suitable for the packaging of the plug-in connector.

As has already been explained above, the insulation insert 1 is formed by a plastic body that was partially metallically coated using an MID process, and this metallically coated part forms the shielding element 3.

All around the circumference of the shielding element 3, clamping means 5 are moulded, the function of which will be described in more detail below. The clamping means 5 substantially have the shape of an arrow and the tip of the arrow points in the plug-in direction.

FIG. 2 shows a second shielding element 6 which, as has already been explained in detail above, serves for electromagnetically shielding two contact elements from each other. The second shielding element substantially has the form of a cross extruded into the space. Each segment that is formed by two wings 7 which extend orthogonally relative to each other, electromagnetically shields here one contact element pair (not shown) from another contact element pair.

The second shielding element 6 is, due to its shape, referred to as a shielding cross by a person skilled in the art. In each case two wings 7 of the shielding cross 6 comprise a radially protruding latching web 9. The latching webs 9 are initially guided in the axial slots 4 of the insulation insert 1, before they latch, behind a narrowing of the respective slots, at a latching point 8.

The second shielding element 6 is here implemented as a separate component. However, it is possible to structurally join the second shielding element 8 directly with the insulation insert 1. In this case, a plastic body would form a body base that is subsequently metallically coated. The metallically coated area would then form the shielding element 3 for the contacting of the cable shielding and would at the same time form the second shielding element 6 for the contact element shielding amongst each other.

FIG. 3 shows a completely packaged plug-in connector 10. The insulation insert 1 is surrounded by a three-part plug-in connector housing 11. The housing part 11*a* forms the plug-in region of the plug-in connector 10 and is axially fixed to the middle part 11*b*, but freely rotatable. In the middle part 11*b*, the insulation insert 1 is substantially embedded.

The shielding element 3 is provided on both sides with a metallic layer. In the inner region 3*a* of the shielding element 3, the shielding braid of the connected cable 12 is contacted. The outer region 3*b* is in conductive contact with the plug-in connector housing 10. The radius of the shielding element 3 is slightly larger than the inner radius of the plug-in connector housing 10 in the corresponding place.

The shielding braid of the cable is contacted through an end side of the shielding element 3. Moreover, in this embodiment, the clamping means 5 compress the shielding element 3 in a radial direction, as a result of which the inner region 3*a* is pressed onto the shielding braid of the cable 12.

Moreover, the clamping means 5 are used as contacting means in metallic plug-in connector housings. By means of the clamping means 5, an electric contact is established between the shielding element 3 and the plug-in connector housing. In this case, the clamping means 5 serve at the same time as contacting means.

The housing part 11*c* substantially forms the cable gland for the plug-in connector 10. As a rule, the housing part 11*c* includes a seal that seals the plug-in connector against the ingress of media such as dust and water. Moreover, the housing part 10 may comprise a cable strain relief.

The cable strain relief may be realised for example by means of a crimping sleeve that is embedded in the housing part 11*c* and is crimped together with the cable sheath.

A particularly preferred variant of the insulation insert is designed as follows:

- in the insulation insert (1), at least one contact element for electrically contacting a conductor core of a cable (12) to be connected may be provided,
- wherein the insulation insert (1) is substantially formed from a plastic body that is partially provided with a conductive coating,
- wherein the coated part substantially forms a shielding element (3) that can be electrically contacted with a shielding braid of the cable (12) to be connected and at the same time with the plug-in connector housing (11),
- wherein clamping means (5) are moreover moulded onto the coated part of the insulation insert (1), as a result of which the insulation insert (1) can be clamped in the plug-in connector housing,
- and wherein the insulation insert (1), including the clamping means (5) and the shielding element (3), is integrally formed.

| List of Reference Numerals | |
|---|---|
| 1. | Insulation insert |
| 2. | Bore |
| 3. | Shielding element |
| 4. | Slot |
| 5. | Clamping means |

-continued

| List of Reference Numerals | |
|---|---|
| 6. | Second shielding element |
| 7. | Wing |
| 8. | Latching point |
| 9. | Latching web |
| 10. | Plug-in connector |
| 11. | a, b, c plug-in connector housing |
| 12. | Cable |

The invention claimed is:

1. An insulation insert that can be inserted into a plug-in connector housing (11) of a plug-in connector (10), wherein in the insulation insert (1), at least one contacting element for electrically contacting a conductor core of a cable (12) to be connected may be provided, characterised in that the insulation insert (1) is provided with a conductive coating in one region, the coated area forms a shielding element (3) that can be electrically contacted with a shielding braid of the cable (12) to be connected and at the same time with the plug-in connector housing (11), on the coated region of the insulation insert, at least one clamping means is moulded that is suitable for clamping in captive manner the shielding element with the plug-in connector housing, in the insulation insert (1), at least two contacting elements for electrically contacting a cable (12) to be connected are provided, the at least two contacting elements are electromagnetically shielded from each other by a second shielding element (6), and the insulation insert (1) and the shielding element (3) are integrally formed.

2. The insulation insert according to claim 1 characterised in that the insulation insert (1) is made from a plastic body that is produced in a two-component injection moulding process, and the insulation insert (1) is provided with a conductive coating partially by using an MID process, wherein the coated region forms the shielding element (3).

3. The insulation insert according to claim 1, characterised in that the at least one clamping means (5) is provided with a conductive coating and is suitable for electrically contacting the plug-in connector housing (11).

4. The insulation insert according to claim 3, characterised in that at least two clamping means (5) are provided.

5. The insulation insert according to claim 1, characterised in that the second shielding element (6) is formed from a plastic that is metallically coated, using an MID process.

6. The insulation insert, according to claim 1, characterised in that the insulation insert (1); the shielding element (3) and the second shielding element (6) are integrally formed.

7. A plug-in connector having an insulation insert according to claim 1.

8. The plug-in connector according to claim 7, characterised by a cable connected to the plug-in connector, wherein the cable has a shielding braid that is connected in an electrically conductive manner to the shielding element (3) of the insulation insert (1).

9. An insulation insert, for inserting into a plug-in connector housing of a plug-in connector, comprising a region having a conductive coating thereon forming a coated region, and a region having no conductive coating thereon forming a non-coated region, wherein the coated region forms, integrally with the insulation insert, a shielding element that can electrically contact, at the same time, a shielding braid of a cable to be connected and the plug-in connector housing, at least two pair of contacting elements for electrically contacting the cable to be connected, a second shielding element electromagnetically shielding each pair of contacting elements from the other pair of contacting elements, and at least one clamp moulded therewith in the region having a conductive coating thereon for clamping in a captive manner the shielding element in the connector housing when the insert is inserted therein.

10. The insulation insert according to claim 9, wherein the insulation insert is made from a plastic body that is produced in a two-component injecting moulding process, and wherein the region has the conductive coating thereon by MID processing.

11. The insulation insert according to claim 9, wherein the at least one clamp enables the shielding element to electrically contact the connector housing.

12. The insulation insert according to claim 11, wherein there are two or more of the at least on clamp.

13. The insulation insert according to claim 9, wherein the second shielding element is MID-metallically coated plastic.

14. The insulation insert according to claim 9, wherein the shielding element and the second shielding element are integrally formed.

15. A plug-in connector comprising the insulation insert according to claim 9, disposed in plug-in connector housing.

16. The plug-in connector according to claim 15, connected to the cable having the shielding braid that is connected in an electrically conductive manner to the shielding element of the insulation insert.

* * * * *